US006024101A

United States Patent [19]

Garner

[11] Patent Number: 6,024,101

[45] Date of Patent: Feb. 15, 2000

[54] HAIR STYLING BRUSH HAVING TWO TEMPERATURE SENSITIVE COLON-CHANGE MATERIALS AND METHOD OF USE

[76] Inventor: Kerry Garner, 24 Barns Lane, Rushall, Walsall, United Kingdom, WS4 1HE

[21] Appl. No.: 09/136,103

[22] Filed: Aug. 18, 1998

[51] Int. Cl.[7] ..... A45D 7/00

[52] U.S. Cl. ..... 132/211; 132/162; 132/226

[58] Field of Search ..... 132/210, 211, 132/122, 148, 162, 163, 221, 226, 229, 237, 238, 239, 245, 262, 268, 228, 227, 117, 118; 15/168, 160, 164, 159.1, 206, 167.1, 27, 104.94; 401/190

[56] References Cited

U.S. PATENT DOCUMENTS

| | | | |
|---|---|---|---|
| 3,665,938 | 5/1972 | Pedersen | 132/233 |
| 3,856,027 | 12/1974 | Legere | 132/148 |
| 3,967,630 | 7/1976 | Zuhlsdorff et al. | 132/262 |
| 4,167,192 | 9/1979 | Arnold | 15/206 |
| 4,425,161 | 1/1984 | Shibahashi et al. | 106/31.17 |
| 4,557,619 | 12/1985 | De Vincentis | 401/901 |
| 4,564,032 | 1/1986 | Araki | 132/232 |
| 4,938,621 | 7/1990 | Pyrozyk | 401/190 |
| 5,249,327 | 10/1993 | Hing | 15/104.94 |
| 5,606,983 | 3/1997 | Monty et al. | 132/229 |

*Primary Examiner*—Todd E. Manahan
*Assistant Examiner*—Eduardo C. Robert
*Attorney, Agent, or Firm*—Albert O. Cota

[57] ABSTRACT

This invention relates to a hair styling brush and method of use. A brush according to the invention will have particular utility with hair which is to be "blow dried", usually after the hair has already been partially dried, for instance after it has been "towel-dried". There is provided a hair styling brush which includes a head, a handle connected to the head, and bristles carried by and projecting from the head wherein the head carries a temperature sensitive color-change material, the material being selected to be inert to hair and adapted to indicate a minimum threshold temperature for hair styling. There is also provided a method of use of such a hair styling brush.

7 Claims, 2 Drawing Sheets

HAIR STYLING BRUSH HAVING TWO TEMPERATURE SENSITIVE COLON-CHANGE MATERIALS AND METHOD OF USE

This invention relates to a hair styling brush and method of use.

A brush according to the invention will have particular utility with hair which is to be "blow dried", usually after the hair has already been partially dried, for instance after it has been "towel-dried".

BACKGROUND TO THE INVENTION

Partially dried (damp) hair can be blow dried using a jet of heated air, typically using a portable, hand-held "hair drier" which has an electrically heated filament over which the air is blown.

Hair can be styled using a hand-held hair styling brush, both by professional hair stylists (e.g. in salons visited by the public) and by individuals in their homes. Whilst still damp a section of hair is wound gently around the brush head and into a curl. The hair is then dried whilst wound about the brush head i.e. in successive wound sections, as by a hair drier. To assist the styling brush to capture and retain the respective hair section, the styling brush head has projecting bristles.

DISCLOSURE OF THE PRIOR ART

For damp hair, a known hair styling brush has a head and integral handle, the head being cylindrical and carrying radially-extending bristles; the handle and head can be of wood e.g. oak, and the bristles of boar hair. There can be between ten and twenty rows of bristles arranged around the head, in longitudinally-extending rows. An alternative hair styling brush has a plastic handle secured to a cylindrical metal barrel e.g. of aluminium, carrying bristles; the barrel is metallic to better conduct the available heat, seeking to ensure that the hair in contact with the barrel is dried uniformly. A hair styling brush is also known which has a metallic strip around a plastic barrel, the strip again being intended to improve the heat equalisation of the h air contact surfaces. Each of these hair styling brushes can be manually rotated to wind on and "trap" a section of hair, and can then be manipulated whilst that trapped hair section is blow dried using a portable hair drier; usually the brush and thus the trapped hair section will be lifted away from the scalp so that the respective hair roots are the first to be dried or so that the air flow separates out and fluffs up (volumises) the hair in accordance with the styling desired.

Also for damp hair, an electrically heated hair styling brush is known, with a two switch temperature control, warning indicator light, and cable swivels to prevent tangling i.e. as the brush is rotated to wind the selected hair section onto the b rush head. Whilst the brush head can be heated directly and so remain hot without need of an external heat source, disadvantages of this brush are that the cable can interfere with an adjacent hair section which has already been styled, and that the electric cable may become damaged and if it then contacts damp hair (waiting to be styled), the consequence can be fatal.

Dry hair can be curled by the simultaneous use of a number of pre-heated "rollers" around each of which an individual section of the hair is wound, the rollers being left in position whilst a curl forms. A disadvantage of rollers is that only hair sections which are spaced apart relatively widely can be curled and so rollers are not suited to many hair styles. Furthermore, manual dexterity, practise and skill are needed to wind the selected section of hair around a roller, so that rollers are not well suited to normal home use. There is a delay before the rollers can be used i.e. whilst they are heated to an appropriate temperature, and since the rollers are applied in succession they may be at different temperatures, with different styling results or a different curl longevity of the resulting curls; there is also the disadvantage that the user has to handle hot rollers, in addition to the converse disadvantage that some of the rollers may have cooled before being selected for use.

A dry-hair roller is known which has a central axially-extending aperture, the aperture being sized to fit over an electrically heated spike so that each roller is heated by conduction, the heat then flowing outwardly from the aperture, and each roller needs to be pre-heated (typically for 15–20 minutes) before being used on the hair. The rollers are typically supplied together with a proprietary heating unit which heats the required rollers simultaneously, so that again some of the rollers may need to be re-heated before they are ready to be used, whilst to be effective the proprietary heating unit needs to be maintained in good order, and its instructions for use closely followed. Care needs to be taken to avoid contact between the hot surface of a roller and the sensitive skin of the face and neck.

Temperature sensitive materials have long been known, and used e.g. in thermometers. Some temperature sensitive materials change colour when a threshold temperature is exceeded, and change back to the original colour when below the threshold temperature.

A hair roller is known which has a temperature sensitive colour-change surface. For instance the roller surface changes colour e.g. from blue (or green) to white when the roller is sufficiently warm to curl the hair, and reverses the colour change when it has cooled below hair curling temperature. These rollers are however intended for use only on dry hair, and have a filled inner core, in each case to retain the heat longer, perhaps up to ten minutes before the rollers need to be removed (and perhaps reheated and replaced) i.e. so that the curl is more firmly "fixed". The inner core however adds weight, so that the rollers can be uncomfortable to wear, and these heavier rollers can pull out the curls whilst being removed from the hair. A hair roller is known from GB 1217233A which uses as a temperature indicator a complex compound of cuprous oxide and mercuric iodide suspended in a solid transparent carrier, the carrier being a soldified solution of a co-polymer e.g. polyvinylacetate or the polymer derived from co-polymerisation of monochliorotrifluoroethylene and vinylidenefluoride.

DISCLOSURE OF THE INVENTION

We now propose a hair styling brush which will reduce the time needed for effective hair curling. The hair styling brush of the invention is dual-use, being available for normal hair brushing (long strokes of the bristles through the hair) as well as hair curling (winding the selected hair section around the blush head).

According to one aspect of the invention we provide a hair styling brush which includes a head, a handle connected to the head, and bristles carried by and projecting from the head characterised in that the head carries a temperature sensitive colour-change material, the material being selected to be inert to hair and adapted to indicate a minimum threshold temperature for hair styling.

Preferably the colour-change material is not released from the brush head when heated, so that the styling brush does not require frequent material replacement or replenishment and so that the hair styling brush is long lasting and can be used many times.

Desirably the colour-change material or some of it will be at one or both ends of the brush head and so he visible even when a section of hair is wound and trapped on the brush head, but not so positioned that it is covered by the user's hand when the user is holding the brush normally by the handle.

The brush head can be heated when being used to hold a section of hair, preferably by an external source of heat. Thus according to another aspect of the invention we disclose a method of using a hair styling brush having a brush head, a handle connected to the brush head, and bristles carried by and projecting from the brush head, which includes the step of winding a section of hair around the brush head characterised in that (i) a temperature sensitive colour-change material which is inert to the hair is provided for the brush head, the temperature sensitive material indicating when the brush head is at a hair styling temperature, and in that (ii) an external source of heat is provided so as to maintain the temperature of at least part of the brush head at a hair styling temperature.

Usefully the temperature sensitive colour-change material is provided prior to winding of a section of hair around the brush head, and is carried by the hair styling brush, preferably by the brush head. Desirably the colour-change material is visible in a mirror during blow drying of the hair so that a user can manipulate the blow drier or equivalent external heating means so as to maintain the brush head temperature at a hair "treatment" temperature suited for faster and/or longer lasting styling of the respective hair sections.

Preferably the external surface of the brush head will carry a heat conductor so that there is heat equalisation of that external surface even though there may be parts which receive less hot air from the blow drier e.g. because they are shielded by the trapped section of hair or because of the manner in which the blow drier is manipulated.

Usefully the handle is releasably connected to the brush head so that the brush head can be replaced by one of different dimension e.g. of different lateral size, for curls of different size. Conveniently the brush head will be cylindrical, with an outside diameter of between 2cm and 4cm, there being suitably three brush heads with respective outside diameters of 2cm, 3cm and 4cm, but certain hair styles may be better achieved using brush heads of a different external cross-section e.g. oval or perhaps even flat.

The temperature sensitive colour-change material can be an external coating for the brush head, around the (lower) projecting part of the bristles i.e. adjacent the brush head. Alternatively the colour-change material can be on or impregnated in (replaceable) strips which for instance are fitted axially to the brush head between some or all of adjacent rows of bristles, or circumferentially around (perhaps helically around) the brush head. In a further embodiment the brush head can have apertures leading to the annulus, with the colour-change material in the annulus but positioned so as to be visible to the user.

An advantage of our invention is that the hair can be curled, including closely curled, or with closely adjacent styling features (by using in known fashion the hair styling brush sequentially on different sections of the hair, with the section of hair held around the brush head being styled), but more efficiently than with prior art brushes or rollers because the temperature of the brush head can be maintained at a styling temperature without need to remove the brush from the hair for re-heating or for an external temperature check. Because the brush head is used in conjunction with an externally applied temperature source it can be used effectively on damp hair, without need for the user to wait until the heat has conducted from the heating spike to the inner annulus and from the inner annulus through the wall of the brush head to the outer periphery.

The hair brush of our invention can if required furthermore include a setting wax or other hair treatment gel or mousse such that release of the setting wax etc can be effected by externally applied heat and so (if desired) can be delayed, typically so that it is released only after the required section of hair has been selected and appropriately wound onto a cool brush head. Thus for home use (and for salon use, in preference to a heating hood) the setting wax can be released by hot air supplied during blow drying (by the heat from a hair dryer); in our disclosed method of use, preheating of the brush head is not necessary i.e. the releasing heat is provided by a dual use tool (hair dryer) already available in most salons and homes, so avoiding the complication, expense and extra storage space needed for the proprietary roller heater unit. Specifically, the wax etc. carried by the styling brush could be released if so desired only after the brush head is in position—perhaps after being repositioned several times i.e. when the user is finally satisfied that the resulting curl will be positioned in accordance with the hair styling selected. The wax can be held in a reservoir e.g. a cartridge received in the handle or forming a replaceable handle and can be released by a user-operated finger trigger, or the bristles can be dipped into the wax. One example of an additional product which can be carried by our styling brush is that known as "silicon serum", said to be a combination of "resins and silicones", and when used as a pre-finishing gel is claimed to cut blow drying time by up to 10%.

SHORT DESCRIPTION OF THE DRAWINGS

The invention will be further described, by way of example, with reference to the accompanying schematic drawings in which.

DESCRIPTION OF EXEMPLARY EMBODIMENTS

Figure 1:
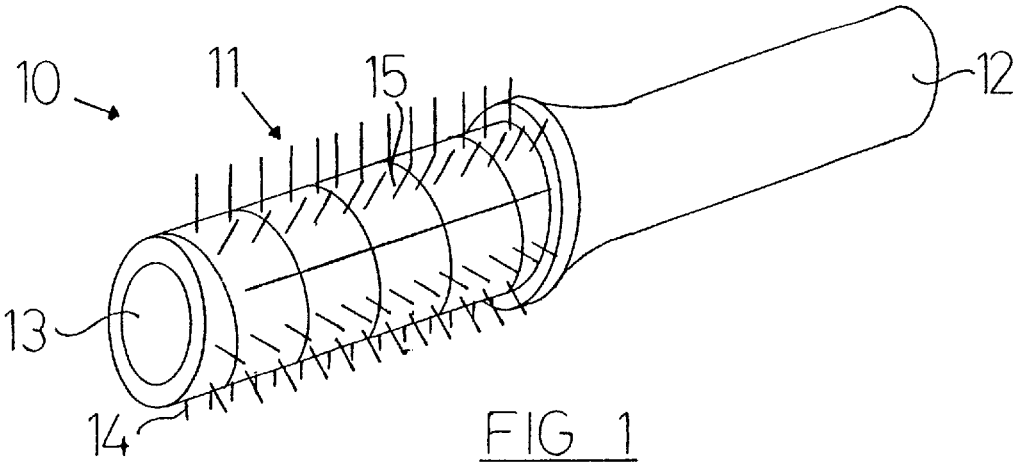
FIG. 1 is a perspective view of one embodiment of hair styling brush according to the invention.

The hair styling brush 10 has a brush head 11 and an integral handle 12. In this embodiment the handle 12 is of rubber to provide a non-slip grip, and surrounds part of a heat conducting core 13, usefully of metal, the rubber handle additionally providing thermal insulation between the core and the user's hand.

The brush head 11 is cylindrical and surrounds another part of the core 13. The head 11 carries a large number of bristles 14, which in this embodiment extend outwards substantially radially but which in alternative embodiments extend at a different angle or are curved, in each case so as gently to hold and trap a section of hair wound around the head 11. The head 11 can be oval in cross-section or might perhaps for some applications be rectangular, or nearly so, in cross-section.

The bristles 14 are mounted to a treated strip 15 which is helically coiled around part of the core 13, to which it is secured in suitable fashion, as by adhesive or a mechanical clip. In an alternative embodiment a wider treated strip is used, with a single turn around the core 13. In a further embodiment the bristles are mounted in standard fashion to the head and project therefrom, and thin treated strips of flexible material are fixed, as by adhesive, to the barrel between the tows of bristles, axially or circumferentially; a particular advantage of this latter embodiment is that the strips can be fixed as a retro-fit to an existing hair styling brush, at positions so that at least a part of a strip is visible in use i.e. with a section of hair wound around the brush head.

In the preferred embodiment the strip or strips 15 are treated with a heat responsive material which is temperature sensitive, with a colour change to indicate that the material and thus the brush head is at a suitable hair treatment temperature, the material being inert to the hair and so being "retained" during use by the brush head i.e. rather than being transferred onto the hair. In an alternative embodiment the heat responsive temperature-change material is carried by the brush head itself and in a further alternative embodiment by the heat conductor.

Figure 2:
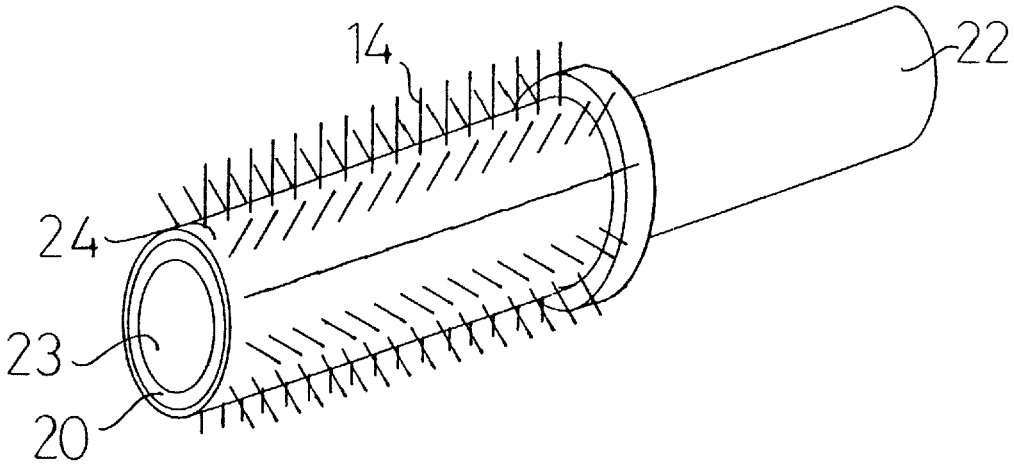
FIG. 2 is a perspective view of a second embodiment of hair styling brush according to the invention.

In the arrangement of FIG. 2 the bristles 14 are carried on a tube 20 which is shaped internally at one end so that it can be retained by an integral extension 23 of handle 22 e.g. the tube 20 is pressed onto the integral extension 23 and adhered or otherwise secured e.g. pinned, into the retained position.

In the embodiment of FIG. 2, the heat conductor is in the form of a perforated metallic barrel 24, which surrounds the tube 20 and through which the bristles 14 can project. The exterior surface of the barrel 24 is treated with a colour change heat sensitive material. In an alternative embodiment the bristles are mounted to the extension 23 and the perforated metallic barrel 24 has an internal diameter significantly greater than the external diameter of the extension 23 so as to provide a gap therebetween, into which blow-dry air can flow, circulate and then exit for effective hair styling e.g. volumising.

Figure 3:
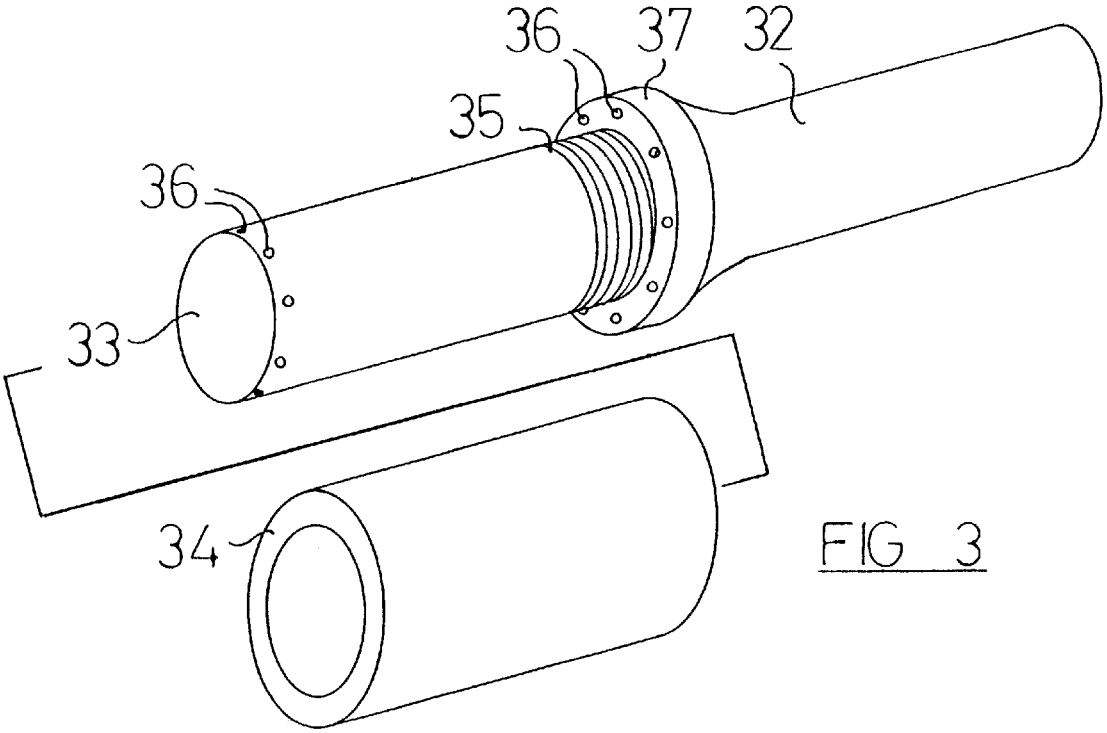
FIG. 3 is an exploded perspective view of a third embodiment of hair styling brush according to the invention.

In the arrangement of FIG. 3 the integral extension 33 is surrounded by a metal heat conducting barrel 34 which has internal screw threads which cooperate with threads 35 on the extension 33. The barrel 34 is tightened on the extension 33 until it abuts the shoulder 37 of the handle 32. An advantage of this arrangement is that the barrel 34 can readily be replaced by a second barrel of different external diameter, for curls of a different size, or of a different external shape for curls of a different style. In an alternative arrangement the barrel 34 can have apertures for air transmission into and out of the barrel, when the barrel 34 is positioned around an extension 33 of smaller diameter, as above described, The heat sensitive colour-change material 36 is carried at spaced positions around the shoulder 37, and at spaced positions around the exposed end of integral extension 33, in both cases so as to be responsive to the temperature of the metal barrel 34, which acts as a heat conductor whereby to equalise the temperature along the barrel. In an alternative embodiment the bristles (not shown in this figure) are carried directly by the metal or other heat conducting barrel 34, or indirectly by way of flexible strips secured to the barrel 34, again with heat sensitive material at both ends of the barrel (and in a further embodiment also along the barrel) so as to remain visible even when a section of hair is trapped by the bristles. Preferably the opposed end portions of the brush do not carry bristles, so that hair is less likely to be wound over these end portions to conceal the colour-change material.

The colour-change material can be circumferentially continuous, perhaps at several axially spaced positions along the brush head, and/or extend axially along the brush head.

In an alternative but less preferred embodiment the bristles can be completely or partially coated with the heat responsive material, which may however be preferable if the material adheres more securely to e.g. plastics bristles than to the metal barrel.

Figure 4:
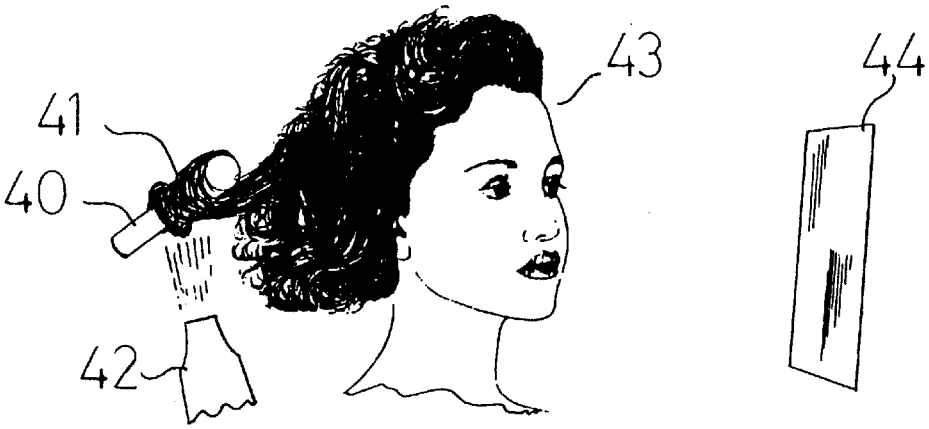
FIG. 4 is a view of a hair styling brush of the invention, in use.

FIG. 4 shows a method of use of the styling brush 40. The brush 40 is held in one hand (not shown) of the user 43, and a section of damp hair 41 is wound around the brush head so as to be held by the bristles, and is then dried by blowing heated air from a portable hair drier 42 onto the section of hair, the hair drier being held by the other hand (also not shown) of the user. The hair drier 42 is manipulated to and fro, and backwards and forwards, relative to the section of hair 41 (and it multi-heat by appropriate setting of the heating coil wattage) so that the colour-change material remains of the colour (in this embodiment visible to user 43 in mirror 44) indicating that the minimum temperature required is being maintained.

It will be understood that the section of hair can be wound in the opposite sense to that shown in FIG. 4 i.e. with the brush head being between the hair length waiting to be wound and the user's scalp, depending upon user preference and the styling selected.

In a suitable alternative arrangement to any of those described above the styling brush carries a second heat responsive material which will colour-change to a different colour at a different temperature i.e, so that the user can be warned, if necessary, that a maximum suggested hair treatment temperature is being exceeded. This second material will be adjacent to the first material e.g. alongside, or if the first material is at circumferentially and/or axially spaced positions between some or all of those positions.

The invention can also be applied to flat-backed brushes, with the colour-change material being in one embodiment impregnated into a thin retro-fit pad which can be pressed onto the bristles of a hair styling brush, the bristles piercing the pad to project therethrough; the pad is therefore preferably replaceable.

A styling brush according to the invention can be used to wind on a section of hair—if necessary with the hair being rewound one or more times so that only the desired section is held by the brush head—before the brush head is heated to treatment temperature; the brush head can be maintained in position for as long as required to ensure a long-life styling of that section i.e without need for premature removal of the brush head because it has cooled; the weight of the brush head is carried by the user's hand, but this weight is not increased by added thermal mass as is used for some rollers to achieve longer heat retention, whilst the weight of the hair drier is taken by the other hand i.e. the weight is shared, and for each hand is kept low. The temperature of the brush head can be maintained above the thresh hold treatment temperature (or between minimum and maximum treatment temperatures) by judicious use of a portable hair drier, and observation of the colour-dependent temperature-change material, selected from those known to persons skilled in the manufacture of hair styling equipment e.g. a cuprous mercuric iodide of formula $xCuI.yHgI_2$, where x and y are each 1–6, and where the material is placed on the brush head (or on a strip to be attached to the brush head as above described) and sealed from the atmosphere by a transparent cured film of a plastics material such as a polyester or a polyolefin; suitably the material is suspended in a transparent carrier before being covered and sealed from the ambient atmosphere. The brush handle remains cool to the touch, being thermally isolated or sufficiently so from the brush head i.e. separate insulated end pieces as are provided for some pre-heated rollers are not required, allowing the full length of the brush head to be used for styling, for the full time required in accordance with the length and texture of the user's hair, as well as the tightness of the desired curl.

Although we foresee that the greatest application of our hair styling brush will be for human hair, it is not limited to that application.

The hair brush of our invention can be used for normal separation of hairs i.e. on dry hair and without need for blow drying, and being "dual use" is thus very cost-effective.

I claim:

1. A hair styling brush which includes a brush head, a handle connected to the brush head, and bristles carried by and projecting from the brush head wherein the brush head carries a first temperature sensitive color-change material, and a second temperature sensitive color-change material, the first and second temperature sensitive color-change materials being selected to be inert to hair, the first temperature sensitive color-change material being adapted to indicate a minimum threshold temperature for hair styling, the second temperature sensitive color-change material being adapted to indicate a maximum threshold temperature for hair styling.

2. A hair styling brush according to claim 1 wherein some or all of the first and second temperature sensitive color-change materials are located at one or both ends of the brush head so as to be visible in use even when a section of hair is wound and trapped on the brush head.

3. A hair styling brush according to claim 1 wherein the head has a heat conductor to provide substantial heat equalization of an external surface of the head.

4. A hair styling brush according to claim 1 wherein the temperature sensitive color-change material is an external coating that is applied to the brush head and to the bristles.

5. A hair styling brush according to claim 1 wherein the colour-change material is impregnated in strips which are adapted to be fitted to the brush head.

6. A hair styling brush according to claim 1 wherein the temperature sensitive color-change material is not released from the brush head when heated and is comprised of a cuprous mercuric iodide of the formula xCuI.yHGI2, where x and y are each between 1 and 6 inclusive.

7. A method of using a hair styling brush having a brush head, a handle connected to the brush head, and bristles carried by and projecting from the brush head, in which a first temperature sensitive color-change material and a second temperature sensitive color-change material which are inert to the hair are provided for the brush head, the temperature sensitive materials indicating when the brush head is between a minimum hair styling temperature and a maximum hair styling temperature, the method including the steps of (i) winding a section of hair around the brush head; and (ii) applying an external source of heat to the brush head and the section of hair such that the color of the first color-change materials changes, thereby indicating that the minimum hair styling temperature required has been reached, whereby said brush head remains this color until the maximum hair styling temperature is attained and the color of said second color-change material changes thus warning the user, so that the brush may be maintained between said minimum and maximum hair styling temperatures.

* * * * *